US009605805B2

(12) United States Patent
Calvin et al.

(10) Patent No.: US 9,605,805 B2
(45) Date of Patent: Mar. 28, 2017

(54) ACTIVE PRESSURE AND FLOW REGULATION SYSTEM

(71) Applicant: Integrys Transportation Fuels, LLC, Chicago, IL (US)

(72) Inventors: Edward A. Calvin, Chicago, IL (US); Wesley W. Wilson, Chicago, IL (US)

(73) Assignee: TRILLIUM TRANSPORTATION FUELS, LLC, Wilmington, DE (US)

( * ) Notice: Subject to any disclaimer, the term of this patent is extended or adjusted under 35 U.S.C. 154(b) by 104 days.

(21) Appl. No.: 14/517,476

(22) Filed: Oct. 17, 2014

(65) Prior Publication Data

US 2015/0122371 A1 May 7, 2015

Related U.S. Application Data

(60) Provisional application No. 61/899,348, filed on Nov. 4, 2013.

(51) Int. Cl.
*F17C 13/02* (2006.01)
*F17C 5/06* (2006.01)

(52) U.S. Cl.
CPC ..... *F17C 13/025* (2013.01); *F17C 5/06* (2013.01); *F17C 2221/033* (2013.01); *F17C 2250/0689* (2013.01); *F17C 2265/065* (2013.01)

(58) Field of Classification Search
CPC .... F17C 13/025; F17C 5/06; F17C 2221/033; F17C 2250/0689; F17C 2265/065
USPC ..... 141/3
See application file for complete search history.

(56) References Cited

U.S. PATENT DOCUMENTS 5,169,295 A * 12/1992 Stogner ..... F04B 9/1174 417/339
5,238,030 A * 8/1993 Miller ..... F17C 5/007 137/80
5,259,424 A * 11/1993 Miller ..... F17C 5/007 137/80
5,427,160 A * 6/1995 Carson ..... F17C 5/06 137/7
5,454,408 A * 10/1995 DiBella ..... F04B 9/1176 141/18
5,458,167 A * 10/1995 Schultz ..... F17C 5/06 141/197
5,505,232 A * 4/1996 Barclay ..... F17C 7/02 123/525
5,513,678 A * 5/1996 Schultz ..... F17C 5/06 141/198
5,628,349 A * 5/1997 Diggins ..... F17C 5/06 141/3

(Continued)

*Primary Examiner* — Timothy L Maust
*Assistant Examiner* — Andrew Schmid
(74) *Attorney, Agent, or Firm* — Banner & Witcoff, Ltd.

(57) ABSTRACT

In processes and systems utilizing a compressor to fill a vessel with gas, for example, in the filling of the fuel tank of a vehicle that operates on compressed natural gas (CNG), a number of advantages are realized by establishing independent control over the flow rate of gas discharged from the compressor, such as on the basis of the compressor discharge pressure, utilizing feedback from one or more gas pressure sensors. In representative embodiments, a detected or actual measured compressor discharge pressure can serve as a process variable, in a feedback control loop for regulating the output of the compressor.

18 Claims, 2 Drawing Sheets

(56) References Cited

U.S. PATENT DOCUMENTS

| | | | | | |
|---|---|---|---|---|---|
| 6,134,896 | A * | 10/2000 | Brown | B60H 1/00585 | 141/83 |
| 6,619,336 | B2 * | 9/2003 | Cohen | F17C 5/06 | 141/18 |
| 6,779,568 | B2 * | 8/2004 | Borck | F17C 5/06 | 137/113 |
| 6,810,924 | B2 * | 11/2004 | White | F17C 5/00 | 141/82 |
| 7,951,225 | B2 * | 5/2011 | Olander | F17C 11/00 | 206/0.7 |
| 8,365,777 | B2 * | 2/2013 | Farese | F17C 13/026 | 141/4 |
| 8,889,347 | B2 * | 11/2014 | Roth | G01N 33/54333 | 422/68.1 |
| 9,234,627 | B2 * | 1/2016 | Cajiga | F17C 1/14 | |
| 9,261,238 | B2 * | 2/2016 | Cohen | F17C 5/06 | |
| 9,303,819 | B2 * | 4/2016 | Hyde | F17D 1/08 | |
| 2008/0209916 | A1 * | 9/2008 | White | F17C 5/02 | 62/48.1 |
| 2010/0228513 | A1 * | 9/2010 | Roth | G01N 21/645 | 702/94 |
| 2013/0248000 | A1 * | 9/2013 | Killeen | F17D 3/00 | 137/14 |

* cited by examiner

ACTIVE PRESSURE AND FLOW REGULATION SYSTEM

CROSS-REFERENCE TO RELATED APPLICATIONS

This application is a non-provisional application under 35 U.S.C. §111(a) and claims the benefit of priority under 35 U.S.C. §119(e) to U.S. provisional application No. 61/899,348, filed Nov. 4, 2013, which is hereby incorporated by reference in its entirety.

FIELD OF THE INVENTION

The present invention relates generally to methods and systems for controlling the output pressure and/or flow rate of a compressed natural gas ("CNG") compressor, for example at a CNG filling station, when filling the tank of a CNG vehicle. A feedback control loop may be used, in which the compressor speed may be regulated based on a measured discharge pressure of the compressor.

DESCRIPTION OF RELATED ART

One of the most significant trends in natural gas applications involves the skyrocketing use of compressed natural gas (CNG), namely natural gas that is compressed to less than 1% of the volume it occupies at atmospheric pressure. The demand for CNG continues to expand, as a fuel for fleet vehicles that log high daily mileage (e.g., taxis, buses, and airport shuttles), and medium- and heavy-duty trucks. In addition, CNG use by railroads as a locomotive fuel is gradually gaining acceptance. At businesses worldwide, CNG continues to make significant inroads as a high-value energy resource for manufacturing and operations processes. Specifically, numerous factors related to natural gas in general, including its "green" environmental-impact advantages and its price stability, are driving business to consider CNG as a viable replacement for liquid petroleum-based fuels. Moreover, the reserves for natural gas are becoming ever more established, particularly in the U.S., as a consequence of leveraging new technologies like hydraulic fracturing.

If the market for CNG transportation fueling infrastructure is to grow beyond the current, primary users, namely high fuel use fleets, it will be necessary to accommodate a variety of vehicle classes and fueling needs. This will require fueling infrastructure to become established between cities, counties, regions, and states. Retail and truck stop outlets will need to be developed in numbers that allow reasonably convenient access to CNG, with fueling stations designed to accommodate any size vehicle and fuel demand. It is estimated that between 12,000 and 24,000 CNG public fueling stations, equivalent to 10 to 20 percent of stations for traditional liquid fuels, will make CNG competitive.

The major difference between fueling of a CNG vehicle and conventional liquid fueling stems from variances in physical properties between gases and liquids, which result in the need for compression and adjustments based on ambient conditions. Compared to conventional liquid fuels, natural gas is similarly simple to use, albeit in a different manner. Manufacturers, distributors, and retailers are continually seeking solutions that enable end users, and particularly CNG vehicle owners (i.e., the ultimate customers), to adapt relatively easily to the logistics involved with filling CNG tanks. A key consideration for achieving industry competitiveness is to provide a user experience that is no more cumbersome than the prevailing expectation associated with the dispensing of liquid fuels, e.g., at self-serve gasoline stations throughout the world. This requires a CNG tank to be filled within a reasonable time (e.g., on the order of several minutes), in a reliable manner, and with a steady transfer from a CNG source to the vehicle.

A CNG compressor, at the heart of any fill station, is responsible for attaining these performance objectives, in the compression and delivery of natural gas at the appropriate pressure for a complete temperature compensated fill of a vehicle tank. CNG compressors are almost invariably reciprocating (positive displacement) machines, meaning that they operate using pistons that displace defined volumes of gas within cylinders. Depending on the number of compression stages, such compressors can increase the pressure of natural gas received at the fill station, for example at a local utility line pressure, to over 4,500 pounds per square inch gauge (psig) pressure, allowing them to provide a standard, temperature compensated fill pressure of 3,600 psig in a vehicle tank. In the case of hydraulic intensifier compressors, a hydraulic pump is used to convey fluid to a hydraulic section of the compressor and thereby control movement of the pistons. The hydraulic pump is operated at a fixed speed or RPM, with a mechanical displacement adjustment mechanism that allows variation of the hydraulic pump output, in order to maintain approximately constant power output over a limited span of discharge pressure. Therefore, to compensate for increased backpressure on the hydraulic pump, its output can lowered to maintain an acceptable load on the electric motor or engine driving the pump. Conventionally, compressors used in CNG filling applications have been operated with no direct control of the compressor speed or output (volumetric flow rate).

While conventional methods of regulating operation of the hydraulic pump effectively achieve the objective of preventing excess equipment loads, there is no independent control over compressor speed. In addition, as the compressor discharge pressure approaches the maximum pressure rating of the system, a safety device must be incorporated to prevent over-pressurization and the associated risks to operating personnel. For this purpose, a recognized technique involves the use of a bypass (or "spillback") valve that allows gas to circulate from the compressor discharge, back to the compressor inlet, thereby relieving the excess gas pressure. While effective in addressing safety issues associated with over-pressurization, a bypass valve is inherently inefficient, as it essentially negates some of the work performed by the compressor, in having already compressed the portion of gas that is returned back through the valve. From an energy perspective, a bypass valve is less than an ideal solution, because each time the bypass opens, all the energy stored in the compressed gas inside the compressor package is lost as the pressure decreases. Moreover, a bypass valve has the undesirable feature of alternating between a very high pressure when closed, and a low pressure when opened. This increases wear and tear on the entire system.

A major objective in the CNG industry is the development of processes and systems that allow users to desirably compress natural gas and fill vehicle tanks, as quickly and efficiently as possible. Ideally, such processes and systems should address known drawbacks as noted above.

SUMMARY OF THE INVENTION

Aspects of the invention relate to processes, systems, and associated control methodologies that actively regulate the output (discharge) pressure and/or flow rate of a gas compressor, utilizing feedback from one or more gas pressure sensors. In representative embodiments, for example, a detected or actual measured compressor discharge pressure can serve as a process variable, in a feedback control loop for regulating the speed of the compressor. Advantageously, these control methodologies are not based on the sole criterion of avoiding an electrical current or mechanical power overload of a hydraulic pump motor or engine, or even maintaining a constant load. Nor do the disclosed CNG filling processes and systems necessarily rely on the use of a bypass valve, which can have the effect of reducing process efficiency and prolonging fill times, as noted above.

A compressor used for filling a vehicle fuel tank or other vessel with compressed natural gas (CNG), i.e., a CNG compressor, may be a hydraulic intensifier compressor, in which the pumping of fluid to a hydraulic section of the compressor dictates the movement of the compressor piston(s). The hydraulic pump may drive two or more gas compression stages, as needed to increase the gas pressure from a suction side, operating at typically on the order of several hundred pounds per square inch gauge pressure (psig), to a discharge side, operating in a range including representative CNG vehicle tank fill pressures. Regulation of the gas flow rate, or rate of transfer of compressed gas from the compressor pistons to a vessel filled by the compressor, can be achieved by changing the displacement volume of the hydraulic pump that drives the compressor. Otherwise, a proportional valve may be used to control the fraction of the hydraulic pump output (hydraulic fluid flow rate) used to drive the compressor. Alternatively, compressor speed may be regulated by controlling the hydraulic pump motor speed or RPM (e.g., of the input shaft), for example using a variable frequency drive. In yet other embodiments, the speed or displacement (piston volume) of the compressor itself may be controlled to directly regulate the flow rate of gas (CNG) to the vessel being filled.

Particular embodiments of the invention are directed to processes for filling a vessel with gas (e.g., CNG). Representative processes comprise compressing a source of the gas, in fluid communication with a suction side of a compressor, to a discharge pressure of a discharge side of the compressor, which is in fluid communication with the vessel. The flow rate of the gas discharged by the compressor, which may correspond to the flow rate entering the vessel, is controlled based on the discharge pressure of the compressor, which may be the actual pressure that is determined (or detected) by a pressure transducer (or pressure transmitter) on the discharge side. The discharge pressure, used as a basis for control of the gas flow rate, may alternatively be corrected for temperature, for example based on the temperature at which the discharge pressure is measured. As described above, gas flow rate control may be established by regulating the speed or the displacement of a hydraulic pump, coupled to the compressor (as in the case of a hydraulic intensifier compressor) and that drives the hydraulic section of the compressor. The gas flow rate control may also be established by regulating the speed or displacement of the compressor itself. This may be performed independently of regulating the output of hydraulic fluid to the compressor, for example, even if this output is maintained constant.

The flow rate of the gas to the vessel may be controlled, more specifically, based on a comparison, for example a difference, between the discharge pressure and a target discharge pressure. The target discharge pressure may be a predetermined value, for example a target fill pressure of the vessel, such as a standard fill pressure of 3,000 psig or 3,600 psig. The target discharge pressure may be corrected for temperature, for example based on the ambient temperature or temperature of the vessel, either of which may be measured continuously or intermittently and used as a basis for correction. More generally, the target discharge pressure may be a constant value during the filling process or otherwise may change based on changing conditions during the process.

Other embodiments of the invention are directed to systems for filling a vessel with gas (e.g., CNG). Representative systems comprise a pressure transducer (or pressure transmitter) for determining (or detecting) a discharge pressure on a discharge side of a compressor, and this discharge side is configured for fluid communication with the vessel. The pressure transducer is configured to provide a signal that regulates a speed or a displacement of a hydraulic pump that drives a hydraulic section of the compressor, or otherwise a speed or a displacement (e.g., piston volume) of the compressor itself. The regulation of any of these parameters may be more specifically based on a comparison between the discharge pressure and a target discharge pressure, as described above.

Further embodiments of the invention are directed to computer program products, and particularly non-transitory computer readable media having computer programs stored thereon. The programs include instructions for causing a processor to perform the steps of (i) receiving, during the filling of a vessel with gas (e.g., CNG), an input signal representative of a discharge pressure (e.g., a temperature corrected discharge pressure) of a discharge side of a gas compressor in fluid communication with the vessel, and (ii) providing an output signal that regulates a speed or a displacement of a hydraulic pump that drives a hydraulic section of the compressor, or otherwise regulates a speed or a displacement (e.g., piston volume) of the compressor itself. The output signal may be based on a comparison (e.g., a difference) between the discharge pressure and a target discharge pressure, as described above.

These and other embodiments and aspects relating to the present invention are apparent from the following Detailed Description.

BRIEF DESCRIPTION OF THE DRAWINGS

A more complete understanding of the exemplary embodiments of the present invention and the advantages thereof may be acquired by referring to the following description in consideration of the accompanying figures, in which the same reference numbers are used to designate the same or similar features, and wherein:

FIGS. 1 and 2 should be understood to present an illustration of the invention and principles involved. Simplified systems and process flows are depicted, and some components may be distorted/enlarged relative to others, in order to facilitate explanation and understanding. Optional equipment and other items not essential to the understanding of the invention, which may include some instrumentation, some process lines, heaters and coolers, etc., are not shown. As is readily apparent to one of skill in the art having knowledge of the present disclosure, processes and associated equipment for carrying the filling of gas storage vessels, according to various other embodiments of the invention, will have configurations and components determined, in part, by their specific use.

DETAILED DESCRIPTION

Figure 1:
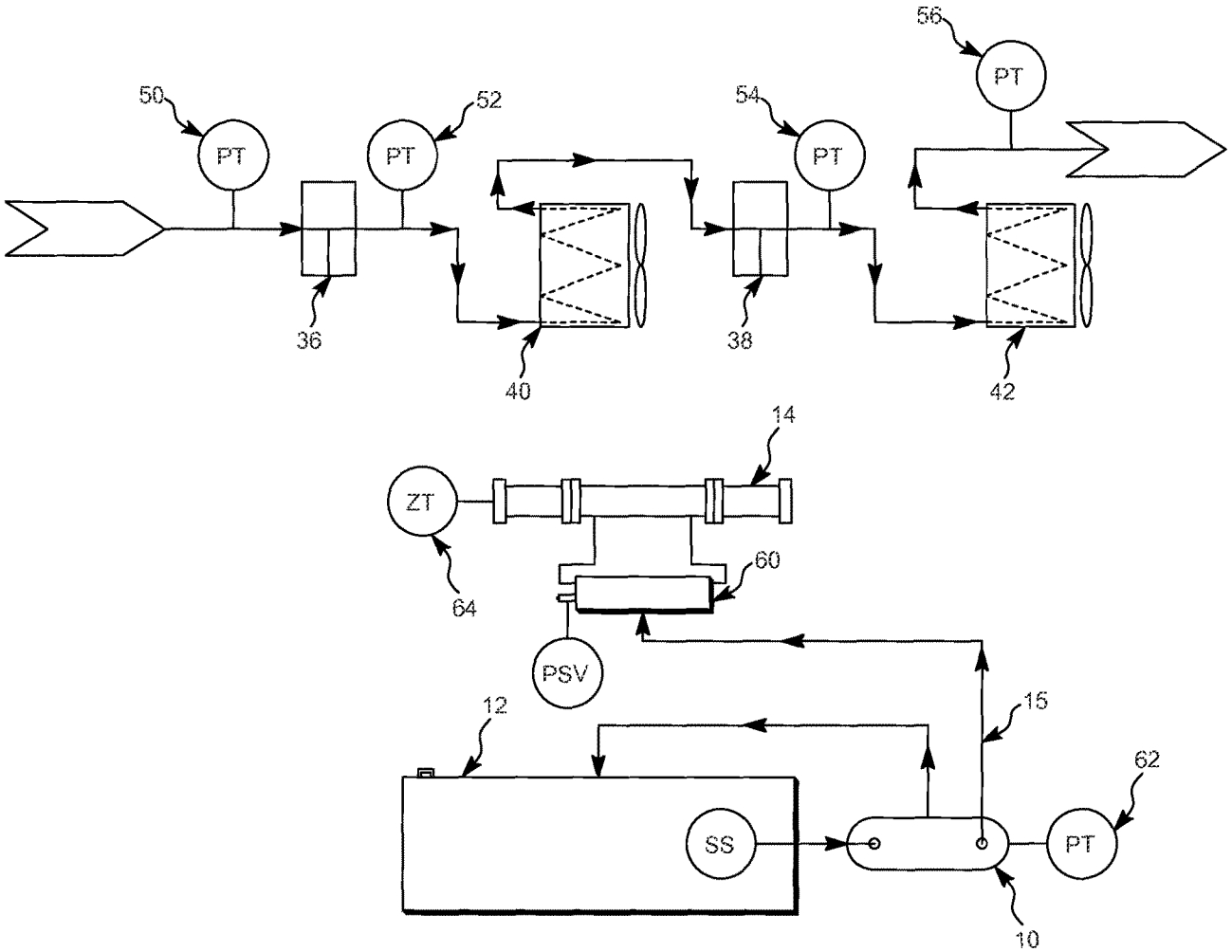
FIG. 1 depicts an embodiment of a process and associated system, which can be used to carry out the filling vessels such as CNG tanks with gas, and whereby the flow rate of gas to the vessel is controlled as described herein.

The present invention relates to methods for filling vessels with gas in a safe and efficient manner, using a compressor. The methods are particularly applicable for use with natural gas, which is understood in the art as referring to a methane-rich product obtained from within the earth (e.g., from underground rock formations) and useful as a fuel for vehicles, in addition to an energy source for heating, cooking, and electricity generation. In particular embodiments, the methods are used for the filling of vehicle fuel tanks with compressed natural gas (CNG), for example at a CNG fill station. Typical supply pressures to the pressure inlet or suction side of the compressor are those that allow a complete fill to be achieved using one or two compression stages. According to other embodiments more than two compression stages may be used, although such operation is not practical in every case. Representative suction pressures, for example, may generally range from about 200 psig to about 3,500 psig, and often from about 500 psig to about 2,000 psig. Representative compressor discharge pressures may be those equal to or above standard fill pressures for CNG vehicle tanks, e.g., at least about 3,000 psig, at least about 3,600 psig, or in a range from about 2,500 psig to about 4,500 psig.

Aspects of invention address drawbacks associated with conventional processes, systems, and control methodologies, by establishing independent control over the flow rate of gas discharged from a compressor, on the basis of the compressor discharge pressure, for example the difference between this pressure and a target discharge pressure, as described above. This independent control may involve regulation of the speed or displacement of a hydraulic pump, coupled to a hydraulic section of the compressor (e.g., in the case of a hydraulic intensifier compressor) and used to drive this hydraulic section. This independent control may otherwise involve regulation of the speed or displacement (piston volume) of the compressor itself. Regardless of the particular manner in which flow rate of compressed gas is controlled, this control may be established in conjunction with an additional control that limits the load on the hydraulic pump, or, more specifically, a motor or engine that drives this pump (e.g., the electrical current, or amperage, drawn from the motor or the horsepower required of the engine). The additional control may be used as an overriding control when needed in view of equipment limitations, but not necessarily as a primary control.

The compressor discharge pressure, used as basis for control, may be detected or measured at any of a number of possible points at the output of a first stage, or higher stage, of compression. Preferably, the detection or measurement is at the output of the final stage of compression, for example the second stage of a two-stage compressor. The detection or measurement may be following, or downstream of, a temperature adjustment, for example after a compressor discharge cooler that removes heat generated from the compression. The detection or measurement may be carried out using a pressure transducer (or pressure transmitter) in fluid communication with the discharge side of the compressor, and particularly at any of these points. The pressure transducer is capable of transmitting a signal, representative of the detected pressure (optionally corrected for the temperature at which this pressure is detected), that regulates the operation of the hydraulic pump, and more specifically the flow rate of hydraulic fluid to the hydraulic section of the compressor. For example, this signal from the transducer may regulate a speed or a displacement of the hydraulic pump. According to other embodiments, the signal that is representative of the detected pressure regulates that operation (speed and/or displacement) of the compressor itself.

In the case of the signal from the pressure transducer being used to regulate displacement, the hydraulic pump may continue to operate at a fixed speed or RPM (e.g., of the input shaft), but through the use of electronic control, the volume of hydraulic fluid displaced by the pump, per pump stroke, can be increased or decreased. Changing the output volume of the pump, in this manner, can regulate the speed at which the compressor pistons move back and forth and thereby control the rate at which gas is compressed (i.e., the gas flow rate). Therefore, when the maximum gas flow rate of the compressor is specified for filling a CNG vehicle tank, the hydraulic pump is adjusted (or instructed to be adjusted, based on the signal from the pressure transducer) to displace as much hydraulic fluid as possible, with each stroke. This maximum gas flow rate specification may occur, for example, at the beginning of the vessel filling, when the vessel pressure, and consequently the compressor discharge pressure, are relatively low and the loads (e.g., electrical and/or mechanical) on the hydraulic pump and compressor are correspondingly low. As the load on the hydraulic pump and/or compressor increase, as a result of increasing compressor discharge pressure during the vessel filling, the gas flow rate can be decreased by decreasing the displacement of the hydraulic pump, thereby effectively decreasing the compressor speed. This, in turn, decreases the amount of gas compressed and volumetric flow rate of gas discharged by the compressor. The load on the pump (e.g., the electrical load on an electricity-driven pump or mechanical load on an engine-driven pump) and/or the load on compressor are reduced.

As described above, therefore, the discharge pressure of the compressor may be used as a basis for regulating the output, or hydraulic fluid flow rate, of the hydraulic pump to the hydraulic section of the compressor. This regulation may be performed manually, but is preferably performed automatically, using a signal from the pressure transducer. This signal may be used, for example, to regulate the displacement of the hydraulic pump. According to the embodiment described above, the output volume, or volume of hydraulic fluid displaced per pump stroke, may be varied. The displacement of the pump, regulated by the pressure transducer, may therefore be a variable output volume, which is characteristic of the operation of a variable displacement pump (e.g., a pump having a cylinder volume that can be varied according to a desired output). In alternative embodiments in which the displacement of the hydraulic pump is regulated, the pump output volume or displacement may be constant, but instead the fraction of hydraulic fluid that is pumped to the hydraulic section of the compressor is varied. In this case, the fluid displaced per pump stroke is not varied per se, but the regulated displacement is rather a variable fraction of the output volume of the hydraulic pump. For example, the pressure transducer may regulate a proportional valve that determines the variable fraction of the output volume, used to drive the compressor hydraulic section. In other embodiments, the signal from the pressure transducer (e.g., in the determination of a difference between the discharge pressure and a target discharge pressure) may regulate the speed or RPM of the hydraulic pump, rather than its displacement, in order to obtain the desired control over the hydraulic fluid flow rate. More specifically, in this case, the pump displacement may remain constant, while the speed (e.g., of a variable frequency drive of the hydraulic pump motor) may be regulated to regulate the number of cylinder volumes of hydraulic fluid transferred per minute to the hydraulic section of the compressor.

According to yet other embodiments, the discharge pressure (or difference between this measured pressure and a target pressure), which may be a signal from a pressure transducer as described above, may directly regulate the speed or displacement (e.g., piston volume) of the compressor itself. This regulation of the compressor may be performed independently of any regulation of the hydraulic pump, e.g., its speed or displacement, as described above. Therefore, the output of the hydraulic pump may remain constant according to particular embodiments in which the compressor is directly regulated. As described above with respect to the hydraulic pump, the displacement of the compressor, or amount of gas displaced per compressor stroke, can be varied. This may be achieved in a manner analogous to regulation of the displacement of the hydraulic pump, and in particular analogous to the regulation of a variable output volume or amount of hydraulic fluid displaced per pump stroke. Thus, a signal from the pressure transducer may regulate the displacement of the compressor, with the displacement, in this case, being a variable piston volume of the compressor. According to specific embodiments, the length of a compressor piston stroke may be varied, for example shortened or otherwise adjusted to a stroke length in the range from 20% to 100% of the full compressor piston stroke length. Generally, for example in the case of cylindrically-shaped pistons, varying the piston stroke length will vary the piston volume by a proportional amount. At a constant compressor speed (e.g., at a constant value in the range from about 20 to about 80 strokes per minute), the adjustment of stroke length can be used to control the gas flow rate, discharged from the compressor, for example by decreasing the volumetric gas flow rate by a proportion substantially representative of the proportional decrease in piston stroke length (which may be a significant decrease, as described above), when the compressor speed is maintained constant.

In practice, it has been observed that control of the compressor piston stroke length alone is generally not a satisfactory solution, because gas movement is unhindered as long as the movement of the piston is sustained. That is, the compressor speed (e.g., in the case of a hydraulic intensifier compressor) has a tendency to increase in a manner that compensates for (is approximately proportional to) the decrease in piston stroke length, such that the gas flow rate is substantially unchanged. Therefore, according to some embodiments, a separate regulation mechanism may be used to maintain compressor speed (e.g., piston strokes per minute) for a given adjustment of piston stroke length. Advantageously, it has been found that regulation (e.g., by the signal from the pressure transducer) of compressor displacement (e.g., piston volume or stroke length), in conjunction with compressor speed, provides for the effective control of the flow rate of gas discharged from the compressor. Specific embodiments of regulating compressor speed include inserting "pauses" between successive piston stokes, of one or more (e.g., two) pistons of the compressor, to maintain a desired number of piston strokes per minute, regardless of piston volume. Representative control methods, for example, include determining a pause, or duration of time, between the end of one compressor stroke and the beginning of the next, successive compressor stroke. The pause may be determined such that the rate (number of strokes per minute) of a piston having an adjusted length, remains the same (or at least approximately the same) as the rate obtained for the piston without having the adjusted length, i.e., compared to the case of 100% piston stroke length without any pauses inserted.

In this manner, the discharge pressure (e.g., signal from the pressure transducer), or otherwise a comparison (e.g., difference) between this pressure and the target pressure, may control gas flow rate from the compressor, by regulating its displacement and, more specifically, a variable piston volume or piston stroke length, in combination with pauses inserted between successive strokes. In representative control algorithms, the pauses will be determined, for example using control software governing the vessel filling, to maintain a desired (or set point) compressor stroke frequency, such as a set point number of strokes per minute as described above. Specific methods may use a control loop, such as a proportional-integral-differential (PID) loop, that determines a percentage of a full compressor piston stroke based on the desired compressor discharge pressure or otherwise the comparison of pressures, as described above. This percentage may be determined in combination with a pause, for simultaneous regulation of both displacement and speed of the compressor. Specific methods may, but do not necessarily, include monitoring the actual piston displacement, for example using one or more position transducers or limit switches, or otherwise using "dead reckoning" based on hydraulic oil flow rate and time, according to art-recognized methods. In one particular embodiment, a position transducer for monitoring piston displacement produces a signal, such as 0-10 volts direct current (VDC), that is proportional to the piston displacement (e.g., distance from one end of the compressor). In yet other embodiments, the gas flow rate may be controlled using pauses alone, such that compressor speed alone is effectively regulated (e.g., by the signal from the pressure transducer), without the simultaneous regulation of piston displacement.

According to yet further embodiments, the compressor discharge pressure may be used as a basis for regulating any, or any combination of, parameters associated with operation of the compressor and/or optional, associated hydraulic pump. As described above, such operating parameters include compressor speed, compressor displacement, hydraulic pump speed, and hydraulic pump displacement. Advantageously, adjustment of any (or any combination) of such operating parameters affecting, directly or indirectly, the output of the compressor, allows representative processes and systems to be "tuned" to deliver, as closely as possible, the highest gas flow rate for a given discharge pressure. Importantly, these performance objectives may be met without the need for a bypass valve or other pressure relief mechanism, as described above, which can limit efficiency. In particular, it is possible, according to some embodiments, for the compressor not to include a bypass for diverting gas, above a maximum discharge pressure, from the discharge side of the compressor to the suction side. According to a control methodology, as described herein, in which gas flow rate is controlled based on a pressure comparison (e.g., pressure difference), it is possible to automatically reduce the discharged gas flow, to zero (0) when the discharge pressure reaches a maximum system pressure, which may be a predetermined pressure. The may be achieved by regulating any of the operating parameters as described above (e.g., by regulating the hydraulic fluid flow to zero at the maximum system pressure). That is, the control methodologies described herein allow for safety regulation, insofar as gas flow can be stopped altogether when a measured discharge pressure reaches a maximum value. Overall, processes and systems, as described herein, can deliver the maximum amount (or flow rate) of gas possible, subject to the constraints of the maximum system gas pressure and the maximum possible output of the hydraulic pump and motor.

Accordingly, representative control methodologies may incorporate one or more constraints, for example, the load on the hydraulic pump motor or engine. In this case, a first potential set point of an operating parameter (e.g., a compressor speed, a compressor displacement, a hydraulic pump speed, or a hydraulic pump displacement) may be determined as described above, based on the comparison between the discharge pressure of the compressor and a target pressure. In addition, a second potential set point of the operating parameter may be determined based on a second comparison relating to the constraint, for example a comparison between (i) the actual motor current or actual engine horsepower of the hydraulic pump and (ii) a maximum motor current or maximum engine horsepower of the hydraulic pump. The set point actually used (actual set point) for regulation of the operating parameter may then be the lower of the first and second, determined potential set points, which generally corresponds to a lower gas flow rate discharged from the compressor. Accordingly, in an initial fill period, the operating parameter may be regulated by the first potential set point, as the actual set point, determined based on the discharge pressure, whereas in a subsequent fill period, the operating parameter may be regulated by the second potential set point, as the actual set point, determined based on the constraint.

In yet other embodiments, first and second potential set points for a combination of operating parameters (e.g., the hydraulic pump speed and hydraulic pump displacement) may be determined, respectively, based on the discharge pressure and the constraint, as described above. In this case, the combination of set points actually used (e.g., the first potential set points or the second potential set points for the hydraulic pump speed and hydraulic pump displacement) for regulation of the operating parameters may be the combination that corresponds to a lower gas flow rate discharged from the compressor. Similar to the case of a single operating parameter being regulated by different set points at different periods of vessel filling, combinations of operating parameters may also be regulated by different combinations of set points, for example set points determined based on the discharge pressure initially, and based on the constraint subsequently, as the discharge pressure of the compressor approaches a target fill pressure of the vessel.

Representative processes and systems may therefore incorporate separate control loops associated with a primary control, based on the compressor discharge pressure, as well as a constraint control. A first control loop may be used for determining a first potential set point of an operating parameter (e.g., hydraulic pump speed or displacement) based on a comparison between the compressor discharge pressure and the target discharge pressure. A second control loop may be used for determining a corresponding, second potential set point for this operating parameter, based on a second comparison relating to a constraint, such as a comparison between an actual and a maximum hydraulic pump motor current or an actual and a maximum hydraulic pump engine horsepower, as described above. Processes and systems incorporating these control loops can generate (I) an actual set point, used for regulation of the operating parameter, that is the lower of these first and second determined set points, or otherwise (II) a combination of actual set points, in the case of using more than one, first control loops for determining first potential set points of multiple operating parameters. The actual set point or combination of actual set points is that which provides the lower gas flow rate discharged from the compressor. Other, corresponding constrained methodologies may be subject to constraints other than the load on the hydraulic pump. For example, a maximum electrical load on the compressor, a maximum speed of the hydraulic pump, or a maximum speed of the compressor may all serve as constraints to avoid operating under one or more undesirable conditions, for example subsequent to an initial filling period that is unconstrained, as described above.

Representative control loops for primary and/or constraint control are proportional-integral-differential (PID) loops, which can be optimized by skilled instrumentation engineers or programmers, such that the control algorithm quickly converges on the correct pump speed or displacement setting (e.g., the actually used set point, as described above), leading to the desired gas flow rate or desired discharge pressure from the compressor. Because measured operating variables, used in various control methodologies as described herein, such as motor current and gas pressure, fluctuate during the course of each pump or compressor stroke, a suitable degree of data "smoothing" (e.g., using a moving average over time) may be required to prevent overregulation of measurement "spikes" occurring over short durations (e.g., over a single compressor stroke). Such data smoothing is also routinely practiced by skilled instrument engineers, having regard for the types of control algorithms described herein.

Figure 2:
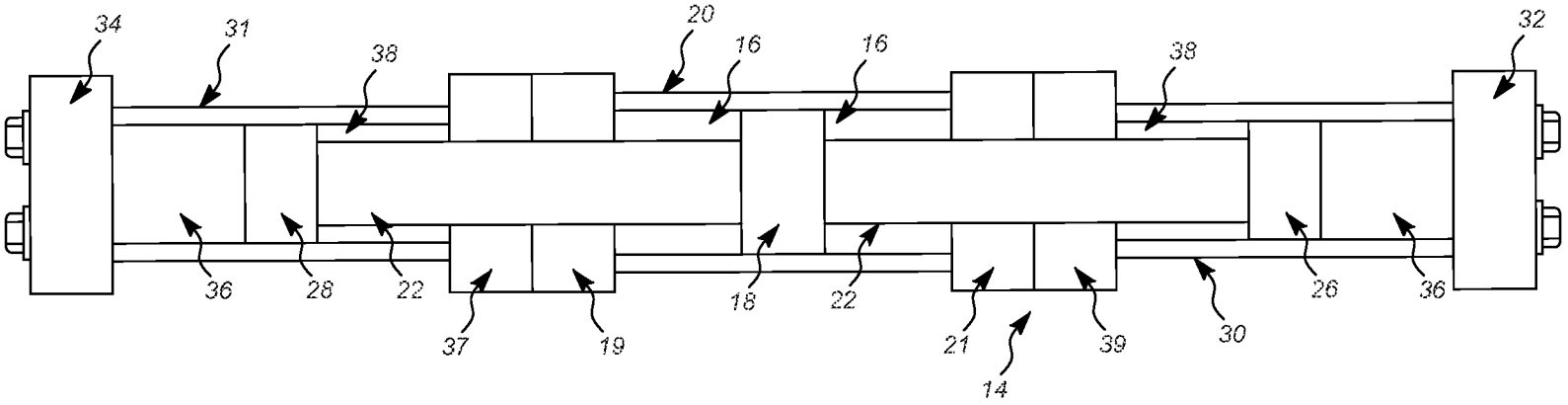
FIG. 2 depicts details associated with a two-stage hydraulic intensifier compressor, which may be used in the representative process and associated system, as depicted in FIG. 1.

According to the embodiment depicted in FIG. 1, a hydraulic pump 10 is fed hydraulic fluid from the hydraulic oil tank 12. The hydraulic pump 10 supplies hydraulic fluid to the hydraulic compressor 14 via hydraulic pump discharge 15. As shown in FIG. 2, the hydraulic compressor 14 includes a hydraulic section 16 where the hydraulic fluid, received from the hydraulic pump, drives a hydraulic piston 18 back and forth within a hydraulic cylinder 20. The volume of space between the hydraulic piston 18 and the inside hydraulic heads 19, 21, forms the hydraulic section 16. The hydraulic piston 18 is mounted on a piston rod 22 that drives two gas pistons 26, 28. The gas pistons move back and forth within two separate gas cylinders 30, 31. As depicted in FIG. 2, the spaces between the gas pistons 26 and 28 and their corresponding outside gas heads 32 and 34, respectively, form the compressor $1^{st}$ stage 36. The spaces between the gas pistons 26, 28 and their corresponding inside gas heads 37 and 39, respectively, form the compressor $2^{nd}$ stage 38.

In operation, the compressor 14 draws gas into the $1^{st}$ and $2^{nd}$ stages through inlet check valves (not shown), which are integral to the gas heads, and discharges gas via outlet check valves (also not shown), which are likewise integral to the gas heads. As shown in FIG. 1, the gas is cooled after leaving the compressor $1^{st}$ stage 36, by the $1^{st}$ stage gas cooler 40, and is cooled after leaving the compressor $2^{nd}$ stage 38, by the $2^{nd}$ stage gas cooler 42. Gas pressure may be monitored at various stages by pressure transducers, designated "PT." For example, an inlet pressure transducer 50 monitors the inlet gas pressure. A $1^{st}$ stage pressure transducer 52 monitors the compressor $1^{st}$ stage discharge pressure. A $2^{nd}$ stage pressure transducer 54 monitors the compressor $2^{nd}$ stage discharge pressure. An after-cooler pressure transducer 56 monitors the after-cooler pressure. Measurements from any of pressure transducers 52, 54, or 56 may be used as a basis for control of the gas flow rate, according to the control methodologies described herein. According to some embodiments, the use of after-cooler pressure transducer 56 may be preferred, if the gas at this point of measurement is cooled to a constant temperature or nearly a constant temperature (e.g., room temperature). In other embodiments, the use of $2^{nd}$ stage pressure transducer 54 may be used, wherein the gas at this point of measurement is not cooled, and therefore the pressure that is used as a basis for control may be corrected for the temperature at this point. Pressure transducer 54 may have the capability to additionally determine this temperature, or otherwise a separate temperature transducer (not shown) may be used.

Referring further to FIG. 1, spool valve 60 directs hydraulic fluid to either side of the hydraulic section of the compressor 14, pushing the pistons in one direction or the other. Hydraulic fluid pressure is monitored by a hydraulic fluid pressure transducer 62, mounted on the hydraulic pump discharge. The position of the pistons within the cylinders is monitored by a position transducer 64 (designated "ZT") that measures the distance of one of the gas pistons from the end of the gas cylinder. According to one possible method of controlling the output, or flow rate of hydraulic fluid, from hydraulic pump 10 to achieve the desired regulation, the following steps are performed manually or automatically: (1) Read, or otherwise obtain, gas discharge pressure that is measured by transducer 56, (2) Read, or otherwise obtain, amperage of motor driving hydraulic pump, (3) Calculate, or otherwise determine, optimal hydraulic pump displacement using a PID loop that compares gas discharge pressure against a target gas pressure, (4) Calculate optimal hydraulic pump displacement using a separate PID loop that compares hydraulic pump motor current against the maximum allowable motor current, (5) Set the hydraulic pump displacement to the lower of the two values calculated in steps 4 and 5, and (6) Repeat steps 1-6.

Aspects of the invention are directed to processes, systems, computer program products, and associated control methodologies for controlling the flow of gas, discharged from a compressor, to a vessel such as a CNG vehicle fuel tank. As described above, representative processes, systems, computer program products, and control methodologies provide various improvements and advantages relative to the conventional use of CNG compressors that operate at a fixed speed and/or a fixed displacement, which limits their scope and window of optimization to one set of pressure and flow conditions. The added ability to regulate various operating parameters (e.g., compressor speed, compressor displacement, hydraulic pump speed, and/or hydraulic pump displacement), according to aspects of the invention as described herein, allows for the control and manipulation of compressor performance in real time during use. This provides superior results, in terms of the fill time and fill quality, which are tailored to the specific vehicle being filled and the specific system being used. Those having skill in the art, with the knowledge gained from the present disclosure, will recognize that various changes could be made in these processes and systems, without departing from the scope of the present invention. While in the foregoing specification the invention has been described in relation to certain preferred embodiments thereof, and details have been set forth for purpose of illustration, it will be apparent to those skilled in the art that the disclosure is susceptible to additional embodiments, based on modification, alteration, changes or substitution of various features described herein, without departing significantly from the spirit of the disclosure. For example, the dimensions, number, size and shape of the various components may be altered to fit specific applications. Accordingly, the specific embodiments illustrated and described herein are for illustrative purposes only, and not limiting of the invention as set forth in the appended claims.

The invention claimed is:

1. A process for filling a vessel with gas, the process comprising:

compressing a source of the gas, in fluid communication with a suction side of a compressor, to a discharge pressure of a discharge side of the compressor in fluid communication with the vessel;

wherein, during a filling period over which the compressor discharge pressure is increased, a flow rate of the gas through the compressor and to the vessel is controlled based on a comparison between the discharge pressure and a target discharge pressure of the compressor or a target pressure of the vessel, wherein the discharge pressure is determined by a pressure transducer in fluid communication with the discharge side, and wherein a signal from the pressure transducer regulates (i) a hydraulic pump speed or a hydraulic pump displacement of a hydraulic pump that drives a hydraulic section of the compressor, or (ii) a speed or a displacement of the compressor.

2. The process of claim 1, wherein the signal from the pressure transducer regulates the hydraulic pump speed or the hydraulic pump displacement.

3. The process of claim 2, wherein the hydraulic pump displacement is a variable fraction of an output volume of the hydraulic pump.

4. The process of claim 3, wherein the signal from the pressure transducer regulates a proportional valve that determines the variable fraction of the output volume of the hydraulic pump.

5. The process of claim 2, wherein the hydraulic pump displacement is a variable output volume from the hydraulic pump.

6. The process of claim 5, wherein the hydraulic pump is a variable displacement pump.

7. The process of claim 2, wherein the signal from the pressure transducer regulates speed of a variable frequency drive of a motor of the hydraulic pump.

8. The process of claim 1, wherein a signal from the pressure transducer regulates a speed or a displacement of the compressor.

9. The process of claim 8, wherein the displacement of the compressor is a variable piston volume of the compressor.

10. The process of claim 8, wherein the signal from the pressure transducer regulates both the speed and the displacement of the compressor.

11. The process of claim 10, wherein the compressor speed is regulated by inserting pauses between successive strokes of one or more pistons of the compressor.

12. The process of claim 1, wherein the compressor does not include a bypass for diverting gas, above a maximum discharge pressure, from the discharge side of the compressor to the suction side of the compressor.

13. The process of claim 1, wherein the hydraulic pump displacement is determined based on the comparison, and a second hydraulic pump displacement is determined based on a second comparison, between a motor current of the hydraulic pump and a maximum motor current, and wherein a hydraulic pump displacement set point is the lower of the hydraulic pump displacement and the second hydraulic pump displacement.

14. The process of claim 1, wherein the gas is natural gas, and the vessel is a compressed natural gas (CNG) tank of a vehicle.

15. The process of claim 1, wherein the source of the gas is provided to the suction side of the compressor, at a pressure from about 200 psig to about 3,500 psig.

16. The process of claim 1, wherein the discharge pressure reaches a fill pressure from about 2,500 psig to about 4,500 psig during the vessel filling process.

17. The process of claim 1, wherein the compressor includes at least two stages of gas compression.

18. The process of claim 1, wherein a flow rate of the gas to the vessel is reduced to zero at a predetermined, maximum system pressure.

* * * * *